US007712549B2

(12) United States Patent
Dennis et al.

(10) Patent No.: US 7,712,549 B2
(45) Date of Patent: May 11, 2010

(54) DRILLING TOOL

(75) Inventors: Mahlon Dennis, Kingwood, TX (US); Thomas Dennis, Kingwood, TX (US); Eric Twardowski, Spring, TX (US)

(73) Assignee: Dennis Tool Company, Houston, TX (US)

( * ) Notice: Subject to any disclaimer, the term of this patent is extended or adjusted under 35 U.S.C. 154(b) by 1215 days.

(21) Appl. No.: 10/988,722

(22) Filed: Nov. 15, 2004

(65) Prior Publication Data

US 2006/0102388 A1 May 18, 2006

(51) Int. Cl.
*E21B 10/26* (2006.01)

(52) U.S. Cl. ..... 175/19; 175/106; 175/334; 175/385

(58) Field of Classification Search ..... 175/19, 175/106, 334, 335, 385, 391
See application file for complete search history.

(56) References Cited

U.S. PATENT DOCUMENTS

| | | | | | |
|---|---|---|---|---|---|
| 2,085,336 | A | * | 6/1937 | Sandstone | 175/104 |
| 3,062,519 | A | * | 11/1962 | Osgood | 299/59 |
| 3,322,466 | A | | 5/1967 | Mennekes | |
| 3,335,806 | A | | 8/1967 | Caro | |
| 3,441,096 | A | | 4/1969 | Lautsch | |
| 3,491,843 | A | | 1/1970 | Rodriguez | |
| 3,517,759 | A | | 6/1970 | Crumbo | |
| 3,669,199 | A | | 6/1972 | Cullen et al | |
| 3,964,555 | A | | 6/1976 | Franklin | |
| 4,004,642 | A | | 1/1977 | Dardick | |
| 4,678,045 | A | | 7/1987 | Lyons | |
| 4,683,964 | A | | 8/1987 | Wenzel | |
| 4,744,426 | A | | 5/1988 | Reed | |
| 4,949,795 | A | * | 8/1990 | McDonald et al. | 175/40 |
| 5,343,964 | A | | 9/1994 | Leroy | |
| 5,472,057 | A | | 12/1995 | Winfree | |
| 5,778,992 | A | | 7/1998 | Fuller | |
| 5,833,018 | A | | 11/1998 | von Gynz-Rekowski | |
| 5,845,721 | A | | 12/1998 | Southard | |
| 6,230,826 | B1 | | 5/2001 | Molly | |
| 6,378,626 | B1 | | 4/2002 | Wallace | |
| 6,488,103 | B1 | | 12/2002 | Dennis et al. | |

FOREIGN PATENT DOCUMENTS

| | | | |
|---|---|---|---|
| DE | 3927625 | A1 | 2/1991 |
| EP | 0 770 759 | A2 | 5/1997 |
| EP | 0 770 759 | A3 | 7/1997 |
| GB | 2 306 529 | A | 5/1997 |

* cited by examiner

*Primary Examiner*—William P Neuder
(74) *Attorney, Agent, or Firm*—Gardere Wynne Sewell LLP; Marc A. Hubbard

(57) ABSTRACT

A drilling tool (10) includes a pilot bit (14) and a plurality of mills (16) encircling the pilot bit. The pilot bit and the plurality of mills are each driven by a separate, hydraulically powered turbine or positive displacement motor. (20) The drilling tool does not include a transmission for transmitting power from the turbine or motor to any of the plurality of mills or the pilot bit.

12 Claims, 2 Drawing Sheets

10
12
14
16
18
20
24
26

DRILLING TOOL

BACKGROUND OF THE INVENTION

The invention relates generally to a tool for forming bores through relatively hard material, and in particular to a rotary drill bit for use in oil and gas exploration and mining.

Bits for drilling through rock are typically outfitted with hard, durable cutters. Cutters with contact surfaces made from polycrystalline diamond compact (PDC) typically wear better and last longer. PDC is an extremely hard and wear resistant material.

PDC cutters are known to have one of the lowest rates of wear when operated at cooler temperatures. Wear rates are low when operational temperatures are maintained below about 700 degrees Celsius. At approximately 700 degrees Celsius, thermal damage to the diamond layer of the cutter begins, lowering wear resistance. Above this critical temperature, the rate of wear of the cutter can be as much as fifty times greater than the rate of wear at cooler temperatures. Consequently, PDC cutters become more susceptible to abrasive wear and breakage from impact when operating at higher temperatures.

Greater tangential cutter velocity causes more friction, thus generating more heat. Cutters moving at higher tangential velocities will thus tend to operate at higher temperatures. At some velocity, frictional heat reaches a level sufficient to cause cutter wear rates to accelerate, reducing the life of the cutters. In conventional PDC drag bits, the tangential velocity of a cutter, when measured relative to the material being cut, depends on the distance of the cutter from the center of rotation of the drill bit. For each rate of rotation of a drill bit of a particular diameter, further displacement of a cutter from the drill bit's axis of rotation proportionately increases the cutter's tangential velocity. Thus, increasing the diameter of a drill bit causes cutters located toward the periphery of the bit to rotate with greater tangential velocity.

Increased application of force also generates more heat. Cutters require more force to penetrate harder rock. Cutters dragging through harder rock have higher wear rates due to the increased application of force. Therefore, the critical point at which the wear rate begins to accelerate is also a function of hardness of rock in addition to the rotational velocity of the drill bit to which the cutter is attached. In softer rocks, accelerated wear rates do not occur until higher rotational speeds are used; in harder rocks, acceleration of the wear rate occurs at much lower rotational speeds.

A number of additional factors also shorten the life of PDC cutters. A cutter's abrupt contact with rock formations also increases the rate of wear of PDC cutters. Drilling with conventional PDC drag bits request application of weight and torque to a drill string to turn the drilling tool face and drive the face into the formation. Torque rotates the bit, dragging its PDC cutters through the formation being cut by the cutters. Dragging generates chips, which are removed by drilling fluids, thereby forming a bore or drilled hole. The drilling action causes a reverse, corresponding torque in the drill string. Because of the length of the drill string, the torque winds the drill string like a torsion spring. If a bit releases from consistent contact with the formation being drilled, the drill string will unwind and rotate backward. Changing the tension in the drill string causes the drill bit to come into irregular, abrupt contact either with the sides of the bore or the exposed formation surface being cut. These irregular contacts can cause impact damage to the cutters. Drill strings will vibrate, sometimes severely, under typical drilling conditions, a drill string rotates at 90 to 150 rpm. These vibrations can also damage a drill bit, including the cutters, as well as the drill pipe, MWD equipment, and other components in the drilling system. "Bit whirl" also contributes to impact loads on PDC cutters. This complex motion of the drill bit is thought to occur due to a combination of causes, including lateral forces on the drill bit due to vibration of the drill string vibration, heterogeneous rock formations, bit design, and other factors in combination with the radial cutting ability of PDC bits. Whirl of a drill bit in a bore subjects PDC cutters on the bit to large impact loads as the bit bounces against rock or other material in the bore. Cutters on these drill bits will lose large chips of PDC from impact, rather than from gradual abrasion of the cutter, thereby shortening the effective life of the cutters and the drill bit.

A drilling tool disclosed in U.S. Pat. No. 6,488,103 of Dennis et al., which is incorporated herein by reference, addresses one or more the problem of adverse thermal and impact effects on cutters and attempts to extend the life of PDC cutters without affecting drilling performance. The tool employs a plurality of satellite mills surrounding a central pilot bit. This arrangement reduces the tangential velocity at which cutters towards the periphery on the drilling tool face collide with material being cut by the drilling tool. A mud or turbine motor rotates the pilot and supplies power to drive shafts on which the satellite mills are mounted through a transmission. In order to avoid having to use seals to protect the bearings and gears from the down hole environment and to retain cooling lubricant, abrasion-resistant bearings and gear surfaces having PDC contact surfaces are used in the transmission. The drilling fluid lubricates and cools the transmission. The PDC surfaces enable the gears and the bearings to withstand the abrasion of the drilling fluids, cuttings and other debris present at the bottom of the hole.

SUMMARY OF THE INVENTION

Unfortunately, PDC surfaces within the transmission are susceptible to cracking. This cracking causes the drilling tool transmission to jam and, consequently, causes the entire drilling tool to fail. Using a sealed transmission might remedy the problem, but it would also introduce substantial complexity and create other reliability problems. For example, seals proposed for the drilling tool transmission may themselves fail, exposing the gearing and bearings to abrasive and corrosive fluids and cuttings commonly present within down hole environment.

The present invention is directed to a drilling tool having one or more of the advantages of the drilling tool described in U.S. Pat. No. 6,488,103, without one or more of the disadvantages mentioned above. An exemplary embodiment of the present invention includes a pilot bit and one or more mills 16 to which are also attached cutters. Each of the shafts are directly coupled to and rotated by turbine or a separate hydraulic positive displacement motor—called a "mud motor"—that is powered by the flow of drilling fluids pumped through a drill string or tubing to which the tool is attached.

An exemplary embodiment of a drilling tool embodying the invention is illustrated in the accompanying drawings, in which:

DETAILED DESCRIPTION

Figures 1, 2, 3, 4, 5:
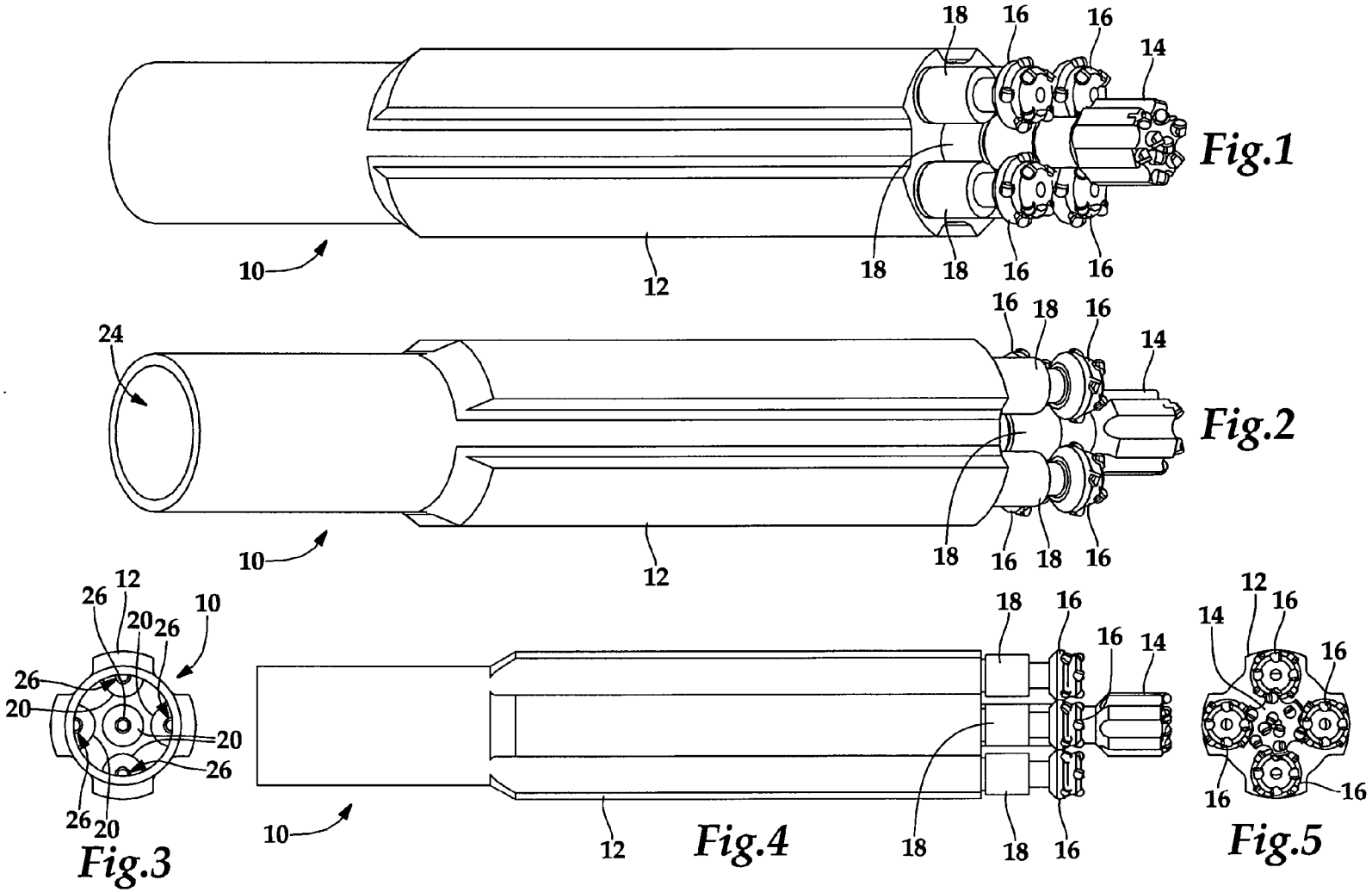
FIG. 1 is a perspective view of a drilling tool, with the tool positioned at an angle so that the cutting end of the tool appears further away than the opposite end of the tool.
FIG. 2 is a perspective view of the drilling tool of FIG. 1, with the tool positioned at an angle so that the cutting end of the tool appears closer, than the opposite end of the tool.
FIG. 3 is an exploded view of a of the main body of the drilling tool of FIG. 1.
FIG. 4 is a side view of the drilling tool 10 of FIG. 1.
FIG. 5 is a front view of a drilling tool of FIG. 1.
Figure 6:
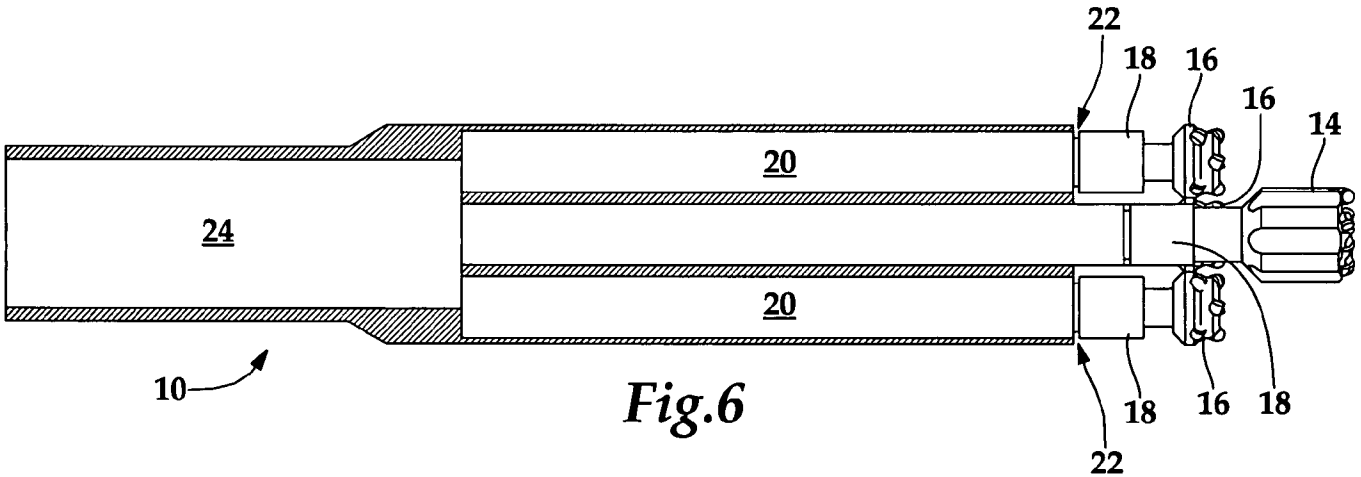
FIG. 6 is a partially sectioned, side view of the drilling tool in FIG. 5, taken along section line 6-6. Only the body of the drilling tool is sectioned. Internal motors, the pilot bit and the mills have not been sectioned.
Figure 7:
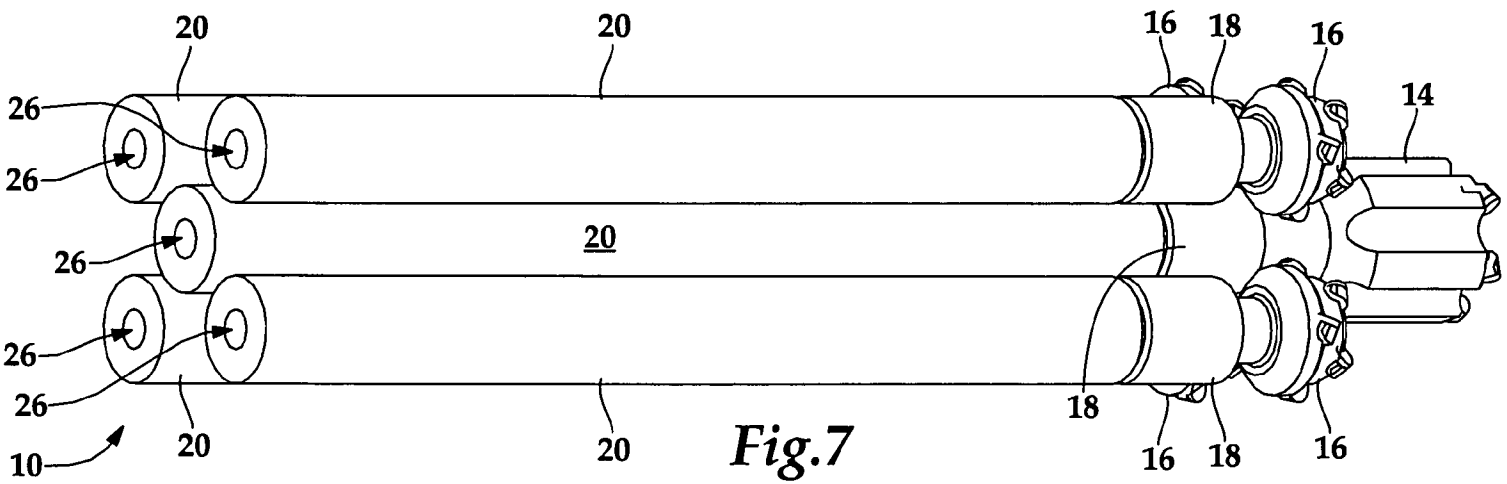
FIG. 7 is a perspective view of just the motors of drilling tool of FIG. 1, connected to the pilot bit and the outer mills. The body of the drilling tool is not shown.

In the following description, like numbers throughout the figures refer to like elements.

Referring to all of the figures, an exemplary embodiment of a drilling tool 10 includes a casing or main body 12, a pilot bit 14, and a plurality of mills 16 disposed about the pilot bit. The pilot bit and the mills are preferably drag bits. Mounted on each of the faces of the pilot bit and mills are cutters, with contact services made preferably a wear resistant material such as PDC. The pilot bit and each of the plurality of mills is coupled to the output of a separate motor disposed within body 12. In the preferred embodiment, the pilot bit and each mill are each coupled to, and thus rotated by, a drive stub 18 or output shaft of a different positive displacement or "mud" motor 20. Pumping of drilling fluid (i.e. "mud") through the pipe or tubing (not shown) to which the tool is attached powers the mud motors or turbine. Mud motors and turbines are well known and frequently used in drilling operations.

Having the pilot bit and each mill driven by a separate motor avoids use of transmission for transmitting power from a single motor to the pilot bit and each of the mills. As described above, transmissions must either be sealed or capable of operating in harsh down hole environments. By doing away with the transmission, reliability issues associated with a transmission are avoided. Directly coupling each bit to the output of each mud motor or turbine does not require additional bearings and gearing (beyond those already included in the mud motor).

Use of separate motors for each pilot bit and mill also permits, unlike a drilling tool having a transmission for distributing power, selection and use of motors with different characteristics, such as different rotation directions, torque, power, and rotational speed, within the same tool. For example, motors may be, at the operator's option, selected that rotate all in the same direction, thus turning all of the bits in the same direction. Or, a motor designed to rotate one direction may be selected for driving the pilot bit in one direction, with the other mud motors being selected to rotate in the opposite direction, thus rotating the mills in the opposite direction from the pilot bit. Similarly, motors for the mills may be run at a different speed than the motor for the pilot bit.

Furthermore, tool 10 is, in the illustrated embodiment, structured to facilitate changing motors, if desired, allowing relatively easy reconfiguration and avoiding the need to build or have on hand multiple drilling tools. In the preferred embodiment, each mud motor is mounted in a motor cavity defined in body that has a shape that complements the desired motor. Mud motors typically have a cylindrical shape, and thus the motor cavities of the preferred embodiment shown figures are cylindrically shaped. Each motor is inserted and removed through an opening 22 in the lower end of body 12. The motors need only be retained by a method (e.g. friction fit) or mechanism capable of holding the weight of the motors, as the forces encountered during drilling will tend to push the motors into the motor cavities and keep them well seated. Each motor may be easily removed and replaced with either a reconfigured motor, if of a type that is reconfigurable, or another motor having the same outer dimensions.

Mud motors 20 are powered hydraulically by drilling fluid entering inlet 26. In the illustrated embodiment, the inlet 26 for each mud motor 20 is automatically situated upon insertion for fluid communication with a reservoir 24. The drill string or tubing is attached to a threaded coupling (threading not shown) at an upper end of tool 10, so that the drilling fluid being pumped down pipe or tubing enters the reservoir and is distributed to each of the mud motors 20. The power generated by each mud motor depends on the pressure differential in the fluid between the inlet and top of the motors and the bottom of the motor. The common reservoir assists with maintaining consistent availability of fluid to all motors and a consistent input pressure of the fluid to each motor. An additional input circuit could be added between, for example, the reservoir and the input of one or more of the motors to modulate pressure or flow of the drilling fluid immediately prior to entering to a particular motor—for example to just the pilot bit—or to all of the motors.

For balancing the drilling tool 10 during operation, it is preferable for the central axis of rotation of the pilot bit 14 to be coincident with the central axis of the drilling tool, and for the axes rotation of each mill to be radially equidistant from the axis of the pilot bit 14. It is also preferable for each mill 16 to have a diameter equal to the diameter of each other mill and has an axis of rotation at and through the center axis of the mill. The mills 16 are arranged, in the illustrated exemplary embodiment, so that the cutting path of each mill partially overlaps the cutting path of the pilot bit 14.

What is claimed in the invention is:

1. A drilling tool comprising:

a casing;

a central pilot bit extending from a first location of a bottom end of the casing, the bit including a plurality of abrasion-resistant cutting elements;

one or more mills extending from at least a second location of the bottom end of the casing and disposed laterally outwardly from the central bit, each of the one or more mills including a plurality of abrasion-resistant cutting elements; and a plurality of motors disposed within the casing, one for each of the one or more mills and the pilot bit, each of the plurality of motors having an output that is coupled directly to separate ones of the pilot or one of the one or more mills without gears or bearings;

wherein each of the plurality of motors is a hydraulically powered, positive displacement motor and/or turbine; and wherein the casing includes a plurality of motor or turbine cavities, each of the plurality of motor or turbine cavities receiving one of the of the plurality of motors or turbine, each motor or turbine cavity having an opening in the bottom end of the tool through which the motor or turbine is received in the tool.

2. The drilling tool of claim 1, wherein an inlet for each motor is in fluid communication with a common reservoir that is defined within the casing for receiving drilling fluid.

3. The drilling tool of claim 1, wherein insertion of each of the plurality of motors or turbines in a respective one of the plurality of motor or turbine cavities automatically establishes fluid communication between the reservoir and the motor.

4. A drilling tool comprising:

a central pilot bit extending from a bottom end of a casing, the bit including a plurality of abrasion-resistant cutting elements;

at least two mills each including a plurality of abrasion-resistant cutting elements, each of the at least two mills having an axis of rotation radially equidistant from and parallel to an axis of rotation of the central pilot bit; and a plurality of motors disposed within the casing, one for each of the at least two mills and the central pilot bit, each of the plurality of motors having an output that is coupled directly to separate ones of the central pilot bit and the at least two mills without gears or bearings;

wherein each of the plurality of motors is a hydraulically powered, positive displacement motor and/or turbine; and wherein the casing includes a plurality of motor or turbine cavities, each of the plurality of motor or turbine cavities receiving one of the of the plurality of motors or turbine, each motor or turbine cavity having an opening in the bottom end of the tool through which the motor or turbine is received in the tool.

5. A method for drilling comprising:

lowering a drilling tool into a well bore, the drilling tool including a casing having a central pilot bit and a plurality of mills, each of the central pilot bit and the plurality of mills extending from a different location from a bottom end of the casing, the plurality of mills disposed peripherally around the central bit, the pilot bit and each of the plurality of mills including a plurality of diamond rolling cutter or other cutting elements; and pumping drilling fluid to the drilling tool, the drilling fluid powering a plurality of hydraulically powered motors or turbine contained within the drilling tool, the pilot bit and each of the plurality of mills being coupled with a different one of the plurality of motors or turbine;

wherein each motor or turbine is in fluid communication with a common reservoir that is defined within the casing for receiving drilling fluid; and wherein the casing includes a plurality of motor or turbine cavities, each of the plurality of motor cavities receiving one of the of the plurality of motors or turbines, each motor or turbine cavity having an opening in the bottom end of the tool through which the motor or turbine is received in the tool.

6. The drilling tool of claim 5, wherein insertion of each of the plurality of motors or turbines in a respective one of the plurality of motor or turbine cavities automatically establishes fluid communication between the reservoir and the motor or turbine.

7. The method of claim 5, wherein each of the plurality of mills have an axis of rotation radially equidistant from an axis of rotation of the central pilot bit.

8. The method of claim 5, wherein a cutting path of the plurality of mills at least partially overlaps a cutting path of the central pilot bit.

9. A drilling tool comprising:

a central pilot bit extending from a bottom end of a casing, the bit including a plurality of abrasion-resistant cutting elements;

at least two mills each including a plurality of abrasion-resistant cutting elements, each of the at least two mills having an axis of rotation radially equidistant from and parallel to an axis of rotation of the central pilot bit; and a plurality of motors disposed within the casing, one for each of the at least two mills and the central pilot bit, each of the plurality of motors having an output that is coupled directly to separate ones of the central pilot bit and the at least two mills without gears or bearings;

wherein each of the plurality of motors is a hydraulically powered, positive displacement motor and/or turbine; and wherein an inlet for each motor is in fluid communication with a common reservoir that is defined within the casing for receiving drilling fluid.

10. The drilling tool of claim 9, wherein a cutting path of the at least two mills at least partially overlaps a cutting path of the central pilot bit.

11. The drilling tool of claim 4, wherein a cutting path of the at least two mills at least partially overlaps a cutting path of the central pilot bit.

12. The drilling tool of claim 11, wherein insertion of each of the plurality of motors or turbines in a respective one of the plurality of motor or turbine cavities automatically establishes fluid communication between the reservoir and the motor.

* * * * *